US006428598B1

(12) United States Patent
Seo

(10) Patent No.: US 6,428,598 B1
(45) Date of Patent: Aug. 6, 2002

(54) ADDITIVE COMPOSITION FOR USE IN SPECIAL STEEL MAKING

(76) Inventor: Un Sik Seo, 727-9, Panpo-1-dong, Seocho-ku, Seoul 137-041 (KR)

( * ) Notice: Subject to any disclaimer, the term of this patent is extended or adjusted under 35 U.S.C. 154(b) by 0 days.

(21) Appl. No.: 09/423,150

(22) PCT Filed: Oct. 12, 1999

(86) PCT No.: PCT/KR99/00612

§ 371 (c)(1),
(2), (4) Date: Apr. 27, 2000

(87) PCT Pub. No.: WO00/23627

PCT Pub. Date: Apr. 27, 2000

(30) Foreign Application Priority Data

Oct. 20, 1998 (KR) ..... 98-43796

(51) Int. Cl.[7] ..... C21C 7/00
(52) U.S. Cl. ..... 75/314; 75/567
(58) Field of Search ..... 75/314, 567

(56) References Cited

U.S. PATENT DOCUMENTS 4,435,210 A * 3/1984 Hirokawa et al. ..... 75/314
6,126,713 A * 10/2000 Igarashi et al. ..... 75/314

FOREIGN PATENT DOCUMENTS

JP 59023811 A * 2/1982

* cited by examiner

*Primary Examiner*—Melvyn Andrews
(74) *Attorney, Agent, or Firm*—Darby & Darby

(57) ABSTRACT

An additive composition for use in steel making, which comprises 84.8–99.3% by weight of an oxide component; 0.5–1.6% by weight of a metal component; and 0.04–0.07% by weight of a rare-earth element component is used in such a way that its four aliquots are each added in a blast furnace. The amount of the composition to be added is dependent on the steel to be produced. It is used at an amount of 15–17% by weight for special carbonic steel, at 18–20% by weight for special tool and die steel and at 21–25% by weight for special high-speed tool steel.

6 Claims, 1 Drawing Sheet

ADDITIVE COMPOSITION FOR USE IN SPECIAL STEEL MAKING

TECHNICAL FIELD

The present invention relates to an additive composition for use in steel making. More particularly, the present invention relates to an additive composition which shows excellent activity in deoxidation, desulphurization and dephosphorization and makes slag to be of high fluidity. Also, the present invention is concerned with a method for making special steel superior in mechanical properties, by. use of the additive composition.

BACKGROUND ART

When making steel, lime (CaO) or fluorite ($CaF_2$), amounting up to 10% by weight of the amount of the ore to be fed, is conventionally added in metal blast furnaces to remove impurities such as phosphorous (P) and sulfur (S) and to make the fluidity of slag better. Also, in order to give the mechanical properties required for the use of special steel, metal additives are frequently used. Such additives, however, play an incomplete role in removing he impurities from iron melts.

In the case of using the metal additives for alloy, their specific gravities are different from that of iron, the base material, so that an imbalance occurs upon formulation of metals. In addition, the metal components of the additives are often oxidized, which makes it more difficult to obtain desired steel products. After all, expensive, high purity metal additives are rising as an alternative, but give rise to an increase in the production cost.

The problems ascribed to the difference in specific gravity may be overcome by stirring the iron melts of metal blast furnaces at constant speeds, but this is extremely difficult. With the aim of avoiding the difference of specific gravity between iron components and alloy additive components in an iron melt, attempts have been made to make alloys in space, which is in a gravity-free state (e.g., M42 steel according to ASTM rule). The resulting alloys, however, are extremely expensive.

Catalytic agents formulated with rare metals were developed to improve such situations. For instance, 0.003% (30 ppm) of bromine element was added to a molten metal to remove P and S therefrom and ultimately to make CBM steel of high hardenability. Recent research for rare earth element combinations of lanthanum (La) and yttrium (Y) has allowed the making of special steel superior in wear resistance, impact resistance and toughness as well as reduced the amounts of conventional metal additives. This method, however, has such a disadvantage that the rare earth elements require the processes necessary for dressing and smelting.

DISCLOSURE OF THE INVENTION

Therefore, it is an object of the present invention to overcome the above problems encountered in prior arts and to provide an additive composition for use in steel making, which is superior in deoxidation, desulphurization and dephosphorization and improves the fluidity of slag.

It is another object of the present invention to provide a method for making special steel superior in mechanical properties, including impact resistance, wear resistance and thermal resistance.

In accordance with an aspect of the present invention, there is provided an additive an additive composition for use in steel making, comprising: 84.8–99.3% by weight of an oxide component; 0.5–1.6% by weight of a metal component; and 0.04–0.07% by weight of a rare-earth element component.

In accordance with another aspect of the present invention, there is provided a method for making special steel, comprising the steps of. adding over four times, four aliquots of the additive composition comprising 84.8–99.3% by weight of an oxide component; 0.5–1.6% by weight of a metal component; and 0.04–0.07% by weight of a rare-earth element component at an amount of 15–25% by weight of a scrap iron base to be molten, in a blast furnace while the temperature is maintained at 1,600–1,700° C.; removing slag from an iron melt in the furnace; and carburizing if the iron melt is short of carbon content.

BRIEF DESCRIPTION OF THE DRAWINGS

The above and other objects, features and other advantages of the present invention will be more clearly understood from the following detailed description taken in conjunction with the accompanying drawings, in which.

BEST MODES FOR CARRYING OUT THE INVENTION

Figure 1A:
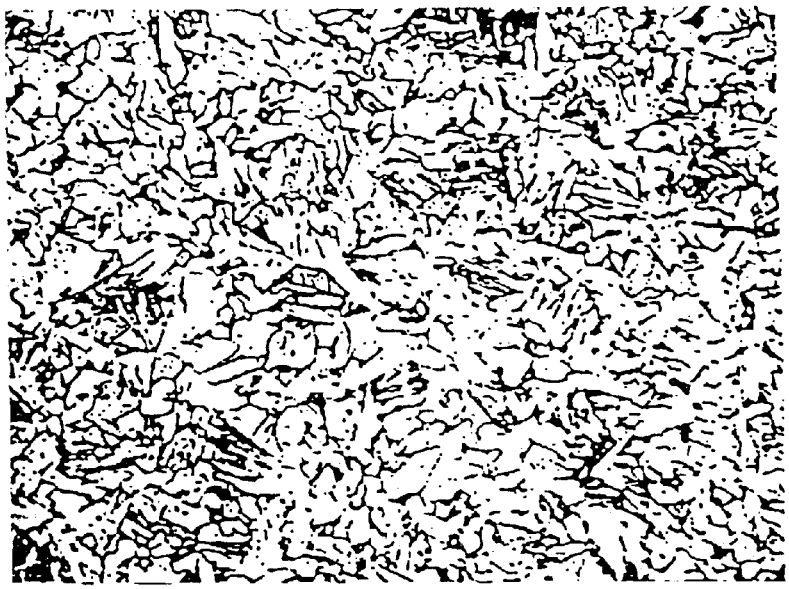
FIGS. 1*a* and 1*b* are microphotographs showing the structures of a conventional steel product and a special high-speed tool steel of the present invention, respectively.

The additive composition useful in making special steel, according to the present invention comprises rare-earth elements (RE), metal elements and metal oxides.

Belonging to the group IIIa in the Periodic Table, the rare-earth elements are composed of 17 elements, that is, scandium (Sc) with an atomic number of 21, yttrium (Y) with an atomic number of 39, and the rare-earth metals, which are divided into the light rare-earth metals ranging, in atomic number, from 57 to 64 and the heavy rare-earth metals ranging, in atomic number, from 65 to 71. In the present invention, all or combinations of the rare-earth elements inclusive essentially of Ce, Nd, Sm, Pr, Eu, Gd and Dy, may be used.

La with atomic number 57, which is believed to give thermal resistance to the steel of the present invention, is preferably added at an amount of 0.009–0.01% by weight (90–100 ppm) based on the total weight of the scrap iron to be fed. Regarding the amounts of the other rare earth elements, 0.012–0.014% by weight (120–140 ppm) are preferable for Ce with 15 atomic number 58, 0.0004–0.0006% by weight (4–6 ppm) for Pr with atomic number 59, 0.0009–0.0011% by weight (9–11 ppm) for Nd with atomic number 60, 0.0009–0.0011% by weight (9–11 ppm) for Sm with atomic number 62, 0.0001–0.0003% by weight (1–3 ppm) for Eu with atomic number 63, 0.0009–0.0011% by weight (9–11 ppm) for Gd with atomic number 64, 0.0005–0.0007% by weight (5–7 ppm) for Dy with atomic number 66, 0.0001–0.0002% by weight (1–2 ppm) for each of Ho, Er and Tu with atomic numbers 67, 68 and 69, respectively, 0.0002–0.0004% by weight (2–4 ppm) for Yb with atomic number 70, 0.002–0.004% by weight (20–40 ppm) for Sc with atomic number 21, and 0.004–0.005% by weight (40–50 ppm) for Y with atomic number 39. The total amount of all of the rare earth elements is preferably on the order of 0.03–0.05% by weight (300–500 ppm) based on the weight of the scrap iron to be fed.

Examples of the metals useful for the present invention include titanium (Ti) with atomic number 22, manganese (Mn) with atomic number 25, chromium (Cr) with atomic number 24, nickel (Ni) with atomic number 28, strontium (Sr) with atomic number 38, barium (Ba) with atomic number 56, and germanium (Ge) with atomic number 32. In accordance with the present invention, all or combinations of the metals, inclusive essentially of Ti, Mn and Cr, are used. In a preferable formulation of the composition, Ti is present at an amount of 1.1–1.5% by weight, Mn at 0.10–0.15% by weight, Cr at 0.01–0.05% by weight, Ni at 0.01–0.03% by weight, Sr at 0.05–0.07% by weight and Ba at 0.04–0.06% by weight.

As for the metal oxides, they comprise $SiO_2$, $Al_2O_3$, CaO, MgO, $Na_2O$, $K_2O$, $CoO_3$ and $Fe_2O_3$. When being molten along with an iron base material in a blast furnace, CaO improves the fluidity of slag in cooperation with the rare earth elements. $SiO_2$ contributes to the absorption of impurities while MgO is preventive of mesotherm. Deoxidation of the iron melt is effected by $Al_2O_3$.

In accordance with the present invention, the metal oxides are contained at an amount of 84.8–99.3% by weight, based on the total weight of the composition, in order to make use of the functions of the oxides.

In accordance with the present invention, the composition comprises 8–10.4% by weight of CaO, 43–45.5% by weight of $SiO_2$, 8–10.4% by weight of MgO, 13–15.5% by weight of $Al_2O_3$, 3–4.8% by weight of $Na_2O$, 1.5–1.9% by weight of $K_2O$, 0.3–0.5% of $CoO_3$, and 8–10.3% by weight of $Fe_2O_3$, based on the total weight of the composition.

Preferably, the additive composition has a particle size of 10 mesh or less. In order not to lose calories while melting iron materials in a blast furnace, the temperature mist be maintained at at least 1,600° C. upon feeding the additive composition.

For making general steel, the additive composition is used at an amount of 0.01–0.10% by weight of the weight of the iron material to be fed. However, the amount of the additive composition depends on the kinds of the steel to be produced. The additive composition is added at an amount of 15–17% by weight of the iron material to be fed, for special carbonic tool steel, at 18–20% by weight for special tool and die steel, and at 21–25% by weight for special high-speed tool steel.

When scrap iron is melted in a blast furnace, metal carbides ($M_xC_y$) and iron carbide ($Fe_3C$) are formed by the actions of the metal components while the rare-earth elements exert potent deoxidation, desulphurization and dephosphorization in the iron melt. In addition, the oxides play a role in improving the fluidity of the iron melt. As a result, the metal carbides and iron carbides together form tight cementite structures in which hexagonal systems are introduced, shortening intercarbonic distances. The carbon steel having such a hexagonal spheroidite is highly resistant to impact, wear and heat. Also, it is greatly improved in hardness and tension and easy to heat-treat without deformation. Consequently, the additive composition of the present invention penetrates into steel by virtue of the affinity and catalytic activity of itself upon melting in a furnace, leading to a great improvement in quality of steel.

A better understanding of the present invention may be obtained in light of the following examples which are set forth to illustrate, but are not to be construed to limit the present invention.

EXAMPLE I

Additive Composition for Use in Steel-Making

An additive composition was prepared as indicated in Table 1, below.

TABLE 1

| Oxides | | Metals | | Rare-Earth Elements | |
|---|---|---|---|---|---|
| Component | wt % | Component | wt % | Component | wt % |
| | | | | Y | 0.0043 |
| | | | | La | 0.0095 |
| | | | | Ce | 0.0131 |
| $SiO_2$ | 45.45 | Ti | 1.13 | Nd | 0.00715 |
| $Al_2O_3$ | 15.33 | Mn | 0.13 | Sm | 0.0010 |
| CaO | 10.19 | Cr | 0.04 | Pr | 0.0005 |
| MgO | 10.07 | Ni | 0.02 | Eu | 0.0002 |
| $Na_2O$ | 4.55 | Sr | 0.06 | Gd | 0.00107 |
| $K_2O$ | 1.79 | Ba | 0.05 | Dy | 0.00062 |
| $CoO_3$ | 0.48 | Ge | | Ho | 0.00010 |
| $Fe_2O_3$ | 10.18 | | | Er | 0.00011 |
| | | | | Tm | 0.00013 |
| | | | | Yb | 0.0005 |
| | | | | Sc | 0.0035 |
| | | | | U | 0.00007 |
| Sum | 98.05 | | 1.43 | | 0.04185 |

The total weight was 99.51185% while ignition loss was 0.48815%.

EXAMPLE II

In making special steel, the additive composition of Example I was used at an amount of 0.08% by weight on the total weight of raw scrap iron (with a content of ca. 0.3% of C, ca. 0.15% of Si and ca. 0.1% of Mn). While four aliquots of the additive composition were each added to the blast furnace, the temperature was always maintained at 1,650° C. to completely dissolve the composition. At this time, a large ignition loss was highly apt to be produced. Thus, slag must be removed with caution against the ignition loss. Thereafter, carburization was executed if the carbon content was measured to be short.

Increasing the fluidity of the slag, the rare-earth elements served to remove phosphorous and sulfur from the molten metal. They were associated with sulphur to give particles such as $RE_2O_2S$ and $RE_2S_3$ or sulfides such as RES which were, then, removed as slag. Some rare-earth elements were associated with $Al_2O_3$ to form $REA1_{11}O_8$ particles which were also removed as slag. That is, rare-earth elements also served as a potent deoxidizer of depriving dissolved oxygens of the metal molts. Therefore, this deoxidation effect could considerably reduce the amount of the deoxidizer added, such as ferro-silicon (Fe—Si) and ferro-manganese (Fe—Mn).

Of the rare-earth elements, La, Y and Ce showed potent catalytic actions. They each combine with carbon at a ratio of one or two molecules per one carbon to give metal carbides which can make the structure of steel better than can iron-carbide ($Fe_3C$) called cementite.

Taken together, the functions of the rare-earth elements make it possible to make high quality special steel which is remarkably free of phosphorous and sulfur, both causing brittleness, and is greatly improved in mechanical properties. Consequently, the additive composition according to the present invention allows the making of special steel superior in mechanical properties, at lower production costs than do conventional additive compositions.

The rare-earth elements added in an electric furnace fiercely react with the iron melts boiling therein, so they are spontaneously mixed together. The iron melts are greatly improved in fluidity by virtue of the oxides of the additive composition, such as CaO. Meanwhile, the impurities resulting from the dephosphorization, desulphurization and deoxidation, such as $RE_2O_2S$, $REA1_{11}O_{18}$, RES and $RE_2S_3$, are absorbed in the slag formed by $SiO_2$, CaO, MgO. The slag rises to t he surface of the iron melts to shield the iron melts from being in contact with the sir, thereby preventing the alloy elements from being oxidized. The various metals of ores are associated with carbon under the potent catalytic action of La, Y and Ce to form metal carbides ($M_xC_y$) in the presence of which the resulting alloy can have superior alloy structures. Cooperating with one another, the additives of the present invention make desired alloy. After taking off the slag and executing a final deoxidizing process, the iron melts are introduced into ingot cases which have a size suitable for rolling and forging. The ingots thus obtained are immediately subjected to annealing before quenching, to rolling or forging at 1,200° C., and to heat treatments depending on their uses.

EXAMPLE III

Special Carbonic Tool Steel

Using the additive composition as indicated in Table 1, special carbon tool steel was made in a similar manner as that of Example II.

That is, an additive composition comprising 0.04% by weight or more of the rare-earth elements, 98% by weight or more of the oxides and 1.4% by weight or more of the metal elements, was added at an amount of 15–17% by weight per ton of scrap iron, followed by addition of 1.5 kg of ferro-titan (Fe—Ti) with a grade of 40%. Impurities were removed from iron melt by the cooperation of the deoxidation due to the catalytic action of the rare-earth elements with the deoxidation, desulphurization and dephosphorization due to the reactions of the oxides, and 40% by weight of the ferro-titan (Fe—Ti) added was made to incorporate in the iron melt, to give five types of novel rare-earth special carbonic tool steel called KRS-2300 series, as shown in Table 2, below.

TABLE 2

Rare-Earth Special Carbonic Tool Steel in KRS-2300 Series

| KRS-2300 series | JIS | ASTM | C | Si | Mn | P | S |
|---|---|---|---|---|---|---|---|
| KRS-2301 | SK-1 | W-13 | 1.30–1.50 | 0.35 | 0.50 | <0.020 | <0.020 |
| KRS-2302 | SK-2 | W-11 | 1.10–1.30 | 0.35 | 0.50 | <0.020 | <0.020 |
| KRS-2303 | SK-3 | W1-9 | 0.90–1.10 | 0.35 | 0.50 | <0.020 | <0.020 |
| KRS-2304 | SK-4 | W1-8 | 0.70–0.90 | 0.35 | 0.50 | <0.020 | <0.020 |
| KRS-2305 | SK-5 | W1-7 | 0.60–0.70 | 0.35 | 0.50 | <0.020 | <0.020 |

EXAMPLE IV

Special Tool and Die Steel

Using the additive composition as indicated in Table 1, special tool and die steel was made in a similar manner as that of Example II.

An additive composition comprising 0.04% by weight or more of the rare-earth elements, 98% by weight or more of the oxides and 1.4% by weight or more of the metal elements, was added at an amount of 18–20% by weight per ton of scrap iron, followed by the iron melt by the cooperative action of the rare-earth elements, the oxides and the ferro-titan. That is, the rare-earth elements catalyzed deoxidation while the oxides showed deoxidation, desulphurization and dephosphorization. In addition, when 40% of the added ferro-titan was incorporated in the iron melt, its potent deoxidation and catalytic action promoted to form iron carbide structures and titanium carbide structures, which led the alloy to spherodized structures, together. Ten types of novel rare-earth special tool and die steel called KRS-2200 series as shown in Table 3, below, were made.

TABLE 3

Rare-earth Special Tool and Die Steel in KRS-2200 SERIES

| KRS Series | JIS | ASTM | C | Si | Mn | P | S | Ni | Cr | Mo | W | V |
|---|---|---|---|---|---|---|---|---|---|---|---|---|
| KRS-2201 | SKS51 | L6 | 0.75–0.85 | 0.35 | 0.50 | <0.02 | <0.02 | 1.3–2.0 | 0.20–0.50 | — | — | — |
| KRS-2202 | SKS21 | — | 1.00–1.10 | 0.35 | 0.50 | <0.02 | <0.02 | — | 0.20–0.50 | — | 0.50–1.00 | 0.10–0.25 |
| KRS-2203 | SKS11 | F2 | 1.20–1.30 | 0.35 | 0.50 | <0.02 | <0.02 | — | 0.20–1.00 | — | 3.00–4.00 | 0.10–0.30 |
| KRS-2204 | SKS4 | — | 0.45–0.55 | 0.35 | 0.50 | <0.02 | <0.02 | — | 0.20–0.50 | — | 0.50–1.00 | — |
| KRS-2205 | SKS44 | $W_{2-8\ 1/2}$ | 0.80–0.90 | 0.35 | 0.50 | <0.02 | <0.02 | — | — | — | — | 0.10–0.25 |
| KRS-2206 | SKS95 | W5 | 0.80–0.90 | 0.35 | 0.50 | <0.02 | <0.02 | — | 0.20–0.60 | — | — | — |
| KRS-2207 | SKS94 | — | 0.90–1.00 | 0.35 | 0.8–1.1 | <0.02 | <0.02 | — | 0.20–0.60 | — | — | — |
| KRS-2208 | SKS3 | 01 | 0.90–1.00 | 0.35 | 0.9–1.2 | <0.02 | <0.02 | — | 0.20–0.60 | — | — | — |
| KRS-2209 | SKD11 | D2 | 1.40–1.60 | 0.40 | 0.60 | <0.02 | <0.02 | — | 11.0–13.0 | 0.80–1.20 | — | 0.20–0.50 |
| KRS-2210 | SKD12 | A2 | 0.95–1.05 | 0.40 | 0.6–0.9 | <0.02 | <0.02 | — | 4.50–5.50 | 0.20–1.20 | — | 0.20–0.50 |

The qualities of the steel obtained were examined and the results are given as shown in Table 4, below.

TABLE 4

Mechanical Properties of KRS-2200 Series Special Tool and Die Steel*

| Samples | Tensile Strength (kgf/mm$^2$) | Yield Point (kgf/mm$^2$) | Elongation (%) | Reduction Area (%) | Impact (kgf/mm$^2$) | Quenching Hardness Avg. | High | Mid. | Low |
|---|---|---|---|---|---|---|---|---|---|
| KRS-2205 | 90.5 | 45 | 15.5 | 28 | 12 | 63.5 | 64 | 63.5 | 63 |
| KRS-2206 | 92.5 | 41 | 15 | 8.5 | 9 | 64.5 | 65 | 64.5 | 64 |

*tested in Korea Advanced Institute of Science and Technology (KAIST), Korea

Hardness was measured to be homogeneous over many parts of the samples. They were higher in tensile strength and elongation than corresponding JIS'. In addition, they were also measured to be strong and very resistant to wear and impact.

Heat treatments were made on the special tool and die steel in KRS-2200 series, according to the present invention, and corresponding mechanical properties were analyzed and their results are given as shown in Table 5, below.

TABLE 5

Heat Treatments and Mechanical Properties of KRS-2200 Series

| KRS series | JIS | ASTM | Annealing | | Quenching | Tempering | |
|---|---|---|---|---|---|---|---|
| KRS-2201 | SKS51 | L6 | 900–925° C. Slow Cooling | HB207 | 80–1,025° C. Oil. Water | 205–540° C. Air | HRC > 62 |
| KRS-2202 | SKS21 | — | 900–925° C. Slow Cooling | HB201 | 80–1,025° C. Oil. Water | 205–540° C. Air | HRC > 63 |
| KRS-2203 | SKS11 | F2 | 900–925° C. Slow Cooling | HB217 | 80–1,025° C. Oil. Water | 205–540° C. Air | HRC > 65 |
| KRS-2204 | SKS4 | — | 900–925° C. Slow Cooling | HB207 | 80–1,025° C. Oil. Water | 205–540° C. Air | HRC > 63 |
| KRS-2205 | SKS4 | $W_{2-8\ 1/2}$ | 900–925° C. Slow Cooling | HB201 | 80–1,025° C. Oil. Water | 205–540° C. Air | HRC > 66 |
| KRS-2206 | SKS95 | W5 | 900–925° C. Slow Cooling | HB212 | 80–1,025° C. Oil. Water | 205–540° C. Air | HRC > 63 |
| KRS-2207 | SKS94 | — | 900–925° C. Slow Cooling | HB217 | 80–1,025° C. Oil. Water | 205–540° C. Air | HRC > 64 |
| KRS-2208 | SKS3 | 01 | 900–925° C. Slow Cooling | HB217 | 80–1,025° C. Oil. Water | 205–540° C. Air | HRC > 64 |
| KRS-2209 | SKD11 | D2 | 900–925° C. Slow Cooling | HB223 | 80–1,025° C. Oil. Water | 205–540° C. Air | HRC > 65 |
| KRS-2210 | SKD12 | A2 | 900–925° C. Slow Cooling | HB217 | 80–1,025° C. Oil. Water | 205–540° C. Air | HRC > 64 |

Comparison between the KRS-2200 series special tool and die steel and the corresponding JIS' was made with regard to mechanical properties and the results are given as shown in Table 6, below.

TABLE 6

Comparison between KRS-2200 Series and JIS

| Heat Treatment/ Properties | KRS-2205 | SKS44 (JIS) | KRS-2208 | SKS-3 (JIS) |
|---|---|---|---|---|
| Heat Treatment | | | | |
| Quenching | 980–1,025° C. Water | 760–820° C. Oil | 980–1,025° C. Oil. Water | 830–880° C. Oil |
| Tempering | 205–540° C. Air | 150–200° C. Air | 205–540° C. Air | 150–200° C. Air |
| HRC | >66 | >62 | >66 | >62 |
| Annealing | 925–980° C. Slow | 730–760° C. Slow | 920–980° C. Slow | 750–200° C. Slow |
| HB | <203 | <213 | <207 | <217 |

TABLE 6-continued

| Comparison between KRS-2200 Series and JIS | | | | |
|---|---|---|---|---|
| Heat Treatment/ Properties | KRS-2205 | SKS44 (JIS) | KRS-2208 | SKS-3 (JIS) |
| Properties | | | | |
| Impact | <10 | >6.5 | >8.3 | >5.5 |
| Tensile Strength (kg/m) | >90 | >50 | >90 | >55 |
| Elongation (%) | >18 | >8.5 | >16 | >7.5 |

As apparent from Table 6, the KRS-2200 series of the present invention are superior to corresponding JISs in various mechanical properties, including hardenability, hardness, tensile strength, impact resistance, wear resistance and processability. Upon heat treatment, the special tool and die steel of the present invention showed almost no decarburization or deformation.

EXAMPLE V

High-Speed Tool Steel

Using the additive composition as indicated in Table 1, high-speed tool steel was made in a similar manner as that of Example II.

TABLE 7

| Rare-Earth High-Speed Tool Steel in KRS-2100 Series | | | | | | | | | | | | |
|---|---|---|---|---|---|---|---|---|---|---|---|---|
| KRS series | JIS | ASTM | C | Si | Mn | P | S | Cr | Mo | W | V | Co |
| KRS-2101 | SKH2 | T 1 | 0.73–0.85 | <0.40 | <0.40 | <0.02 | <0.02 | 3.80–4.50 | — | 17.0–19.0 | 0.80–1.20 | — |
| KRS-2102 | SKH3 | T 4 | 0.73–0.80 | <0.40 | <0.40 | <0.02 | <0.02 | 3.80–4.50 | — | 17.0–19.0 | 0.80–1.20 | 4.50–5.50 |
| KRS-2103 | SKH4 | T 5 | 0.73–0.80 | <0.40 | <0.40 | <0.02 | <0.02 | 3.80–4.50 | — | 17.0–19.0 | 1.00–1.50 | 10.0–11.0 |
| KRS-2104 | SKH10 | T 10 | 1.45–1.60 | <0.40 | <0.40 | <0.02 | <0.02 | 3.80–4.50 | — | 11.5–13.5 | 4.20–5.20 | 4.20–5.20 |
| KRS-2105 | SKH51 | M 2 | 0.80–0.90 | <0.40 | <0.40 | <0.02 | <0.02 | 3.80–4.50 | 4.50–5.50 | 5.50–6.70 | 1.60–2.20 | — |
| KRS-2106 | SKH52 | M 3 | 1.00–1.10 | <0.40 | <0.40 | <0.02 | <0.02 | 3.80–4.50 | 4.50–5.50 | 5.50–6.70 | 2.30–2.80 | — |
| KRS-2107 | SKH54 | M 4 | 1.25–1.40 | <0.40 | <0.40 | <0.02 | <0.02 | 3.80–4.50 | 4.50–5.50 | 5.50–6.50 | 3.90–4.50 | — |
| KRS-2108 | SKH56 | M 36 | 0.85–0.95 | <0.40 | <0.40 | <0.02 | <0.02 | 3.80–4.50 | 4.60–5.30 | 5.70–6.70 | 1.70–2.20 | 5.50–7.00 |
| KRS-2109 | SKH58 | M 7 | 0.95–1.05 | <0.40 | <0.50 | <0.02 | <0.02 | 3.80–4.50 | 8.20–9.20 | 1.50–2.10 | 1.70–2.20 | — |
| KRS-2110 | SKH59 | M 42 | 1.00–1.15 | <0.40 | <0.50 | <0.02 | <0.02 | 3.80–4.50 | 9.00–10.0 | 1.20–1.50 | 0.90–1.40 | 7.50–8.50 |

An additive composition comprising 0.04% by weight or more of the rare-earth elements, 98% by weight or more of the oxides and 1.4% by weight or more of the metal elements, was added at an amount of 21–25% by weight per ton of scrap iron, followed by addition of 3 kg of ferro-titan (Fe—Ti) with a grade of 40%. Impurities were removed from the iron melt by the cooperative action of the rare-earth elements, the oxides and the ferro-titan. That is, the rare-earth elements catalyzed deoxidation while the oxides showed deoxidation, desulphurization and dephosphorization. In addition, when 40% of the added ferro-titan was incorporated in the iron melt, its potent deoxidation and catalytic action promoted to form iron carbide structures and titanium carbide structures, which together led the alloy to spherodized structures. Ten types of novel rare-earth high-speed tool steel called KRS-21 00 series as shown in Table 7, below, were made.

The qualities of the steel obtained were examined and the results are given as shown in Table 8, below.

TABLE 8

Mechanical Properties of KRS-2100 Series Special High-Speed Tool*

| Sample | Wear Resistance | Hot Harness | Toughness | Grindability | Quenching Hardncss (HRC) Avg. | High | Mid. | Low |
|---|---|---|---|---|---|---|---|---|
| KRS-2110 | 5. | 3. | 8. | 5. | 67.5 | 67. | 67.5 | 68. |

*tested in KAIST, Korea

Hardness was measured to be high and homogeneous over many parts of the sample. It was superior to corresponding JIS' in grindability and toughness. It was also measured to be high in wear resistance and impact resistance, low in impurity content and homogeneous in quality.

Figure 1B:
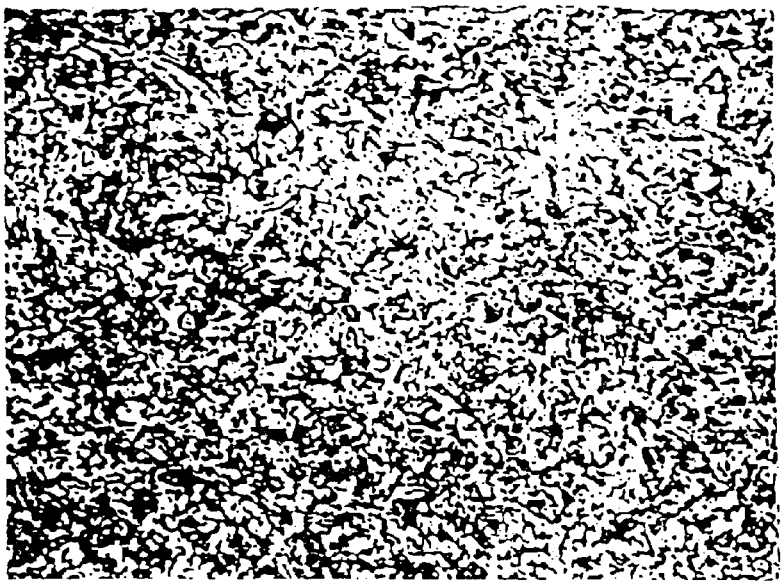

With reference to FIGS. 1*a* and 1*b*, there are microphotographs showing the structure of a conventional product and that of the special high-speed tool steel of the present invention. As shown, the structure of the tool steel according to the present invention is tighter by 200% or more than that of the conventional product.

INDUSTRIAL APPLICABILITY

As described hereinbefore, the additive composition in accordance with the present invention makes steel tight in structure and provides it with a great improvement in the resistance to impact, wear and heat. So, the present invention is very useful to regenerate scrap iron.

The present invention has been described in an illustrative manner, and it is to be understood the terminology used is intended to be in the nature of description rather than of limitation. Many modification and variations of the present invention are possible in light of the above teachings. Therefore, it is to be understood that within the scope of the appended claims, the invention may be practiced otherwise than as specifically described.

What is claimed is:

1. An additive composition for use in steel making, comprising:

84.8–99.3% by weight of an oxide component selected from CaO, $SiO_2$, MgO, $Al_2O_3$, $Na_2O$, $K_2O$, $CoO_3$, $Fe_2O_3$, and any combination thereof;

0.5–1.6% by weight of a metal component selected from Ti, Mn, Cr, Ni, Sr, Ba, Ge, and any combination thereof; and 0.04–0.07% by weight of a rare-earth element component selected from Y, La, Ce, Nd, Sm, Pr, Eu, Gd, Dy, Ho, Er, Tm, Yb, Sc, U, and any combination thereof.

2. The additive composition as set forth in claim 1, wherein said oxide component comprises 8–10.4% by weight of CaO, 43–45.5% by weight of $SiO_2$, 8–10.4% by weight of MgO, 13–15.5% by weight of $Al_2O_3$, 3–4.8% by weight of $Na_2O$, 1.5–1.9% by 0.3–0.5% by weight of $CoO_3$, and 8–10.3% by weight of $Fe_2O_3$, based on the total weight of the composition.

3. The additive composition as set forth in claim 1, wherein said metal component comprises Ti, Mn and Cr.

4. The additive composition as set forth in claim 3, wherein said metal component comprises 0.45–1.3% by weight of Ti, 0.1–0.2% by weight of Mn and 0.01–0.05% by weight of Cr, based on the total weight of the additive composition.

5. The additive composition as set forth in claim 1, wherein said rare-earth element component comprises Ce, Nd, Sm, Pr, Eu, Gd and Dy.

6. The additive composition as set forth in claim 5, wherein said rare-earth element component comprises 0.01–0.015% by weight of Ce, 0.005–0.01% by weight of Nd, 0.0005–0.0015% by weight of Sm, 0.0003–0.0006% by weight of Pr, 0.0001–0.0003% by weight of Eu, 0.0005–0.0015% by weight of Gd and 0.0005–0.0008% by weight of Dy.

* * * * *